US009022755B2

(12) United States Patent
Junod et al.

(10) Patent No.: US 9,022,755 B2
(45) Date of Patent: May 5, 2015

(54) VOLUMETRIC PUMP AND ITS DRIVING MECHANISM

(75) Inventors: Florent Junod, Veigy Foncenex (FR); Philippe Vuichard, Dingy en Vuache (FR)

(73) Assignee: Swissinnov Product SARL (CH)

( * ) Notice: Subject to any disclaimer, the term of this patent is extended or adjusted under 35 U.S.C. 154(b) by 731 days.

(21) Appl. No.: 13/126,065

(22) PCT Filed: Jul. 8, 2009

(86) PCT No.: PCT/IB2009/006189

§ 371 (c)(1), (2), (4) Date: Apr. 26, 2011

(87) PCT Pub. No.: WO2010/049765

PCT Pub. Date: May 6, 2010

(65) Prior Publication Data

US 2011/0206545 A1 Aug. 25, 2011

Related U.S. Application Data

(63) Continuation-in-part of application No. PCT/IB2008/054529, filed on Oct. 30, 2008.

(51) Int. Cl.

| | |
|---|---|
| ***F04B 7/00*** | (2006.01) |
| ***F04B 1/047*** | (2006.01) |
| ***F04B 1/053*** | (2006.01) |

(52) U.S. Cl.

CPC ..... *F04B 7/0007* (2013.01); *F04B 1/0472* (2013.01); *F04B 1/0474* (2013.01); (Continued)

(58) Field of Classification Search

CPC A61M 5/14216; F04B 7/0003; F04B 7/0015; F04B 7/0042; F04B 7/0053; F04B 13/00; F04B 39/08; F04B 53/12; F04B 53/121; F04B 53/122; F04B 53/125

USPC ..... 417/490, 496, 499, 510, 511, 517, 518, 417/560, 561; 604/152

See application file for complete search history.

(56) References Cited

U.S. PATENT DOCUMENTS 84,816 A * 12/1868 Snell ..... 417/518
84,846 A * 12/1868 Snell ..... 417/518

(Continued)

FOREIGN PATENT DOCUMENTS

EP 1817499 B1 10/2008
FR 551600 A 4/1923

(Continued)

OTHER PUBLICATIONS

International Search Report for PCT/IB2009/006189, Completed by the European Patent Office on Feb. 11, 2010, 2 Pages.

*Primary Examiner* — Peter J Bertheaud
(74) *Attorney, Agent, or Firm* — Brooks Kushman P.C.

(57) ABSTRACT

The pump includes a housing containing a hollow elongated part, a piston arranged to move back and forth inside an elongated part, an inlet port and an outlet port arranged so that a fluid can be sucked through the inlet port into a chamber during an instroke of the piston and expelled through the outlet port during an outstroke. A linearly and/or angularly actuable valve system has a valve holder mounted on the pump housing which includes at least one through-hole extending from the piston chamber to the housing outer surface. The valve holder contains an inlet and/or outlet to alternately connect the inlet and outlet ports of the volumetric pump.

11 Claims, 16 Drawing Sheets

(52) U.S. Cl.
CPC ..... *F04B1/0531* (2013.01); *F04B 1/0536* (2013.01); *F04B 7/0015* (2013.01); *F04B 7/0046* (2013.01); *F04B 7/0053* (2013.01); *F04B 7/0057* (2013.01)

(56) References Cited

U.S. PATENT DOCUMENTS

| | | | | | |
|---|---|---|---|---|---|
| 141,394 | A | * | 7/1873 | Snell | 417/518 |
| 991,802 | A | * | 5/1911 | Robinson | 417/518 |
| 1,834,080 | A | * | 12/1931 | Woelfel | 417/518 |
| 2,049,391 | A | | 7/1936 | Gee et al. | |
| 4,396,385 | A | * | 8/1983 | Kelly et al. | 604/152 |
| 5,246,354 | A | * | 9/1993 | Pardinas | 417/500 |
| 5,312,233 | A | | 5/1994 | Tanny et al. | |
| 7,887,308 | B2 | * | 2/2011 | Navarro | 417/461 |
| 8,353,688 | B2 | * | 1/2013 | Navarro | 417/461 |

FOREIGN PATENT DOCUMENTS

| | | | |
|---|---|---|---|
| GB | 191204375 | A | 2/1913 |
| GB | 860616 | A | 2/1961 |
| WO | 2006056828 | A1 | 6/2006 |

* cited by examiner

VOLUMETRIC PUMP AND ITS DRIVING MECHANISM

CROSS-REFERENCE TO RELATED APPLICATION

This application is the U.S. national phase of PCT Appln. No. PCT/IB2009/006189 filed Jul. 8, 2009 which claims priority to PCT Appln. No. PCT/IB2008/054529 filed Oct. 30, 2008, the disclosures of which are incorporated in their entirety by reference herein.

TECHNICAL FIELD

The present invention concerns a multi-scaled volumetric pump and its driving mechanism. The inner construction of this pump can be designed for dispensing fluid with a flow rate ranging from liters down to nanoliters per hour in order to be used in different fields, mainly in the pharmaceutical and medical industries where the delivery of a precise amount of an active substance can be of the utmost importance. This pump is particularly adapted to deliver insulin doses to treat patients suffering from diabetes. Other applications in the food, chemical or other industries can also be contemplated.

BACKGROUND OF THE INVENTION

Many of the existing volumetric pumps known in the art, such as the ones described in GB860616, U.S. Pat. No. 5,312,233 and EP1817499, comprise a single piston in a chamber. The piston instroke fills the piston chamber with a specific amount of a fluid (filling phase) while the piston outstroke releases said amount of fluid out of the chamber (releasing phase). Unlike other pumps where the piston and the valve system are driven independently from each other, these pumps are driven by a mechanism which couples the piston strokes with the movement of the valve system. This guarantees that the valve commutations always occur at the end of a stroke of the volumetric pump avoiding possible back flow. A major drawback of these pumps is that the flow rate of the released fluid is intermittent as no fluid is expelled during the piston instroke.

International application No. WO2006056828, which is incorporated hereing by reference, describes a volumetric pump comprising first and second pistons whose movements inside their respective chambers is synchronized such that a specific amount of fluid is sucked in during the instroke of one piston while the same amount of fluid is expelled during the outstroke of the other piston. The first and second pistons are arranged along a longitudinal axis inside first and second hollow cylindrical parts (chambers) which are assembled end-to-end facing each other to form a housing. A valve disc (valve system), which comprises an inlet and outlet port connected respectively to an inlet and outlet T-shaped channel, is mounted between the first and second piston inside the housing and is arranged to be animated by a combined bidirectional linear and angular movement which couples the piston strokes with the movement of the valve system. More precisely, the linear movement of the disc produces a to-and-fro sliding of the cylindrical housing along the axis of the pistons causing an alternate instroke of the first and second pistons followed by an alternate outstroke of the first and second pistons inside their respective chambers while its angular movement synchronizes the first piston chamber filling phase with the second piston releasing phase. This synchronization is achieved by the inlet and outlet T-shaped channel located inside the valve disc which connects alternately the inlet port to the first and second chamber, and the first and second chamber to the outlet port when said channels overlap alternately an inlet aperture and an outlet aperture located across the diameter of both cylindrical parts adjacent to the lateral sides of said disc. The flow of the fluid released by this pump is quasi-continuous.

However, the flow rate of the fluid delivered by this pump is irregular given that it is directly dependent on the distance travelled by each piston inside its respective cylinder. In fact, the pressure produced when the first and second pistons are alternately in their releasing phase varies according to a sinusoidal curve. As a result, the flow rate of the liquid released by the pump progressively increases as one of the two pistons begins its outstroke until said piston reaches the middle of its stroke. Subsequently, the flow rate progressively decreases as the piston reaches the end of its stroke. At this specific time, both pistons are immobilized for a short time to ensure no pumping movement when the valves are commuting (idle time) before beginning another cycle. Thus, no liquid is released during the idle time.

A major drawback of this volumetric pump is that the inlet and outlet aperture, arranged to be aligned alternately with the inlet and outlet T-shaped channel, are located across the diameter of both cylindrical parts adjacent to the lateral sides of the valves disc. As a result, the volume reduction of the first and second chamber is limited to the size of the apertures below which it would be insufficient to guarantee a normal flow delivery.

In addition, the inner construction of this volumetric pump make it difficult to integrate further chambers in parallel which could provide a solution for obtaining a continuous and steadier flow rate when working at a certain pressure.

SUMMARY OF THE INVENTION

An aim of the present invention is to provide a volumetric pump whose valves configuration does not restrict the miniaturization of at least one piston chamber.

Another aim of the present invention is to provide a volumetric pump whose inner construction is not an obstacle for the development of an upgraded version capable of delivering a fluid at a continuous and steadier flow rate.

These aims are achieved by a volumetric pump as defined in the claims.

There is accordingly a volumetric pump comprises a housing containing at least one hollow elongated part; at least one piston arranged to move back and forth inside said elongated part; a linearly and/or angularly actuable valve system; and at least one inlet/outlet ports mounted on the valve system and arranged so that a fluid can be sucked through the inlet port into a chamber during an instroke of the piston and expelled from the chamber through the outlet port during an outstroke of said piston. The valve system comprises at least one valve holder mounted on the pump housing such that a surface of the valve holder is held against a part of the housing outer surface. The pump housing comprises at least one through-hole extending from the piston chamber to said part of the housing outer surface. The valve holder contains at least one inlet and/or outlet aperture(s) and is arranged to be actuable linearly and/or rotatably to align alternately the inlet and outlet apertures with the through-hole of the housing in order to connect alternately the inlet and outlet ports of the volumetric pump with the piston chamber during alternate piston instrokes and outstrokes.

BRIEF DESCRIPTION OF THE DRAWINGS

The invention will be better understood thanks to the following detailed description of several embodiments with reference to the attached drawings, in which.

DETAILED DESCRIPTION OF EMBODIMENTS OF THE INVENTION

Figure 1:
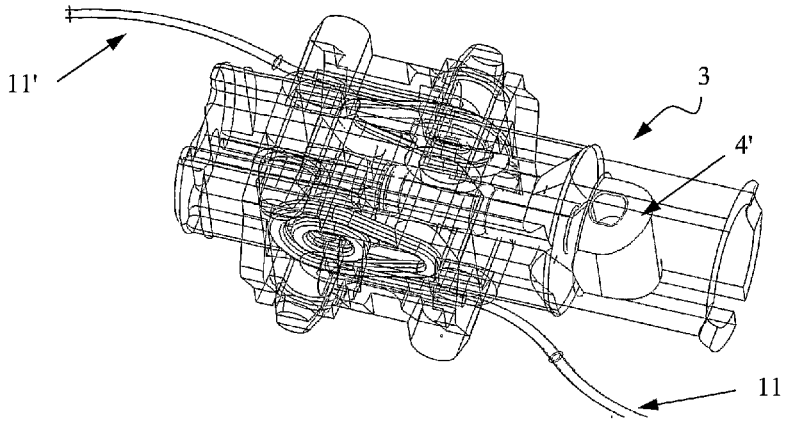
FIG. 1 shows, in a see-through perspective top view, a volumetric pump according to a first embodiment of the invention.
Figure 2:
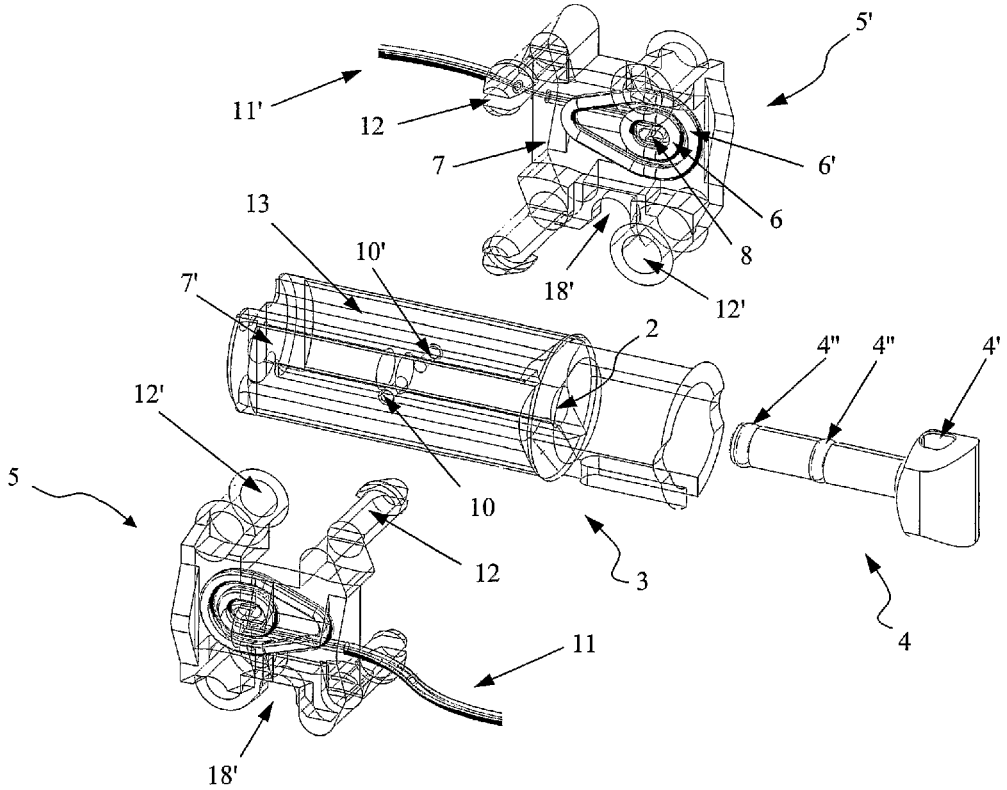
FIG. 2 shows an exploded view of the principal components of the volumetric pump shown in FIG. 1, namely a housing comprising a hollow cylindrical part, a piston and a to-and-fro linearly-actuable valve system composed of a first inlet holder and a second outlet holder.

According to the first embodiment of the present invention, the volumetric pump comprises a hollow cylindrical part 2 contained inside a housing 3 said housing 3 preferably having a rectangular prism-shaped outer surface, a piston 4 with two sealing members 4", said piston 4 being mounted to move back and forth inside the cylindrical part 2 and a to-and-fro linearly-actuable valve system composed of an inlet and outlet valve holder 5, 5' (FIG. 2). Said holders 5, 5' comprise respectively an inlet and outlet port 11, 11'. Two valve gaskets 6, 6' are arranged on a flat rectangular surface 7 of each holder 5, 5' around an elongated aperture 8, 8' connected respectively to an inlet and outlet channel 9, 9'.

Two opposite lateral sides of the housing 3 comprise respectively an inlet and outlet through-hole 10, 10' extending from the piston chamber to the housing outer surface. Each of said lateral sides has been truncated to obtain a flat surface 7' against which one of the two holder rectangular surfaces 7 is held to seal the inlet and outlet port 11, 11' of the volumetric pump. The inlet and outlet valve holders 5, 5' are linearly actuable to align the elongated aperture 8 alternately with the inlet and outlet through hole 10, 10' in order to connect the inlet channel 9 with the piston chamber during the piston instroke and the piston chamber with the outlet channel 9' during the piston outstroke.

Each valve holder 5, 5' comprises near its corners male and female protruding parts 12, 12' extending perpendicular to its flat surface 7 so that both valve holders 5, 5' can be assembled opposite to each other on both lateral sides of the housing 3. The volumetric pump contains guidance means comprising two longitudinal grooves 13 on both the upper and lower lateral sides of the housing 3, inside which lower and upper parts of the inlet and outlet valve holder 5, 5' are slidably mounted.

Figures 3A, 3B, 3C, 3D:
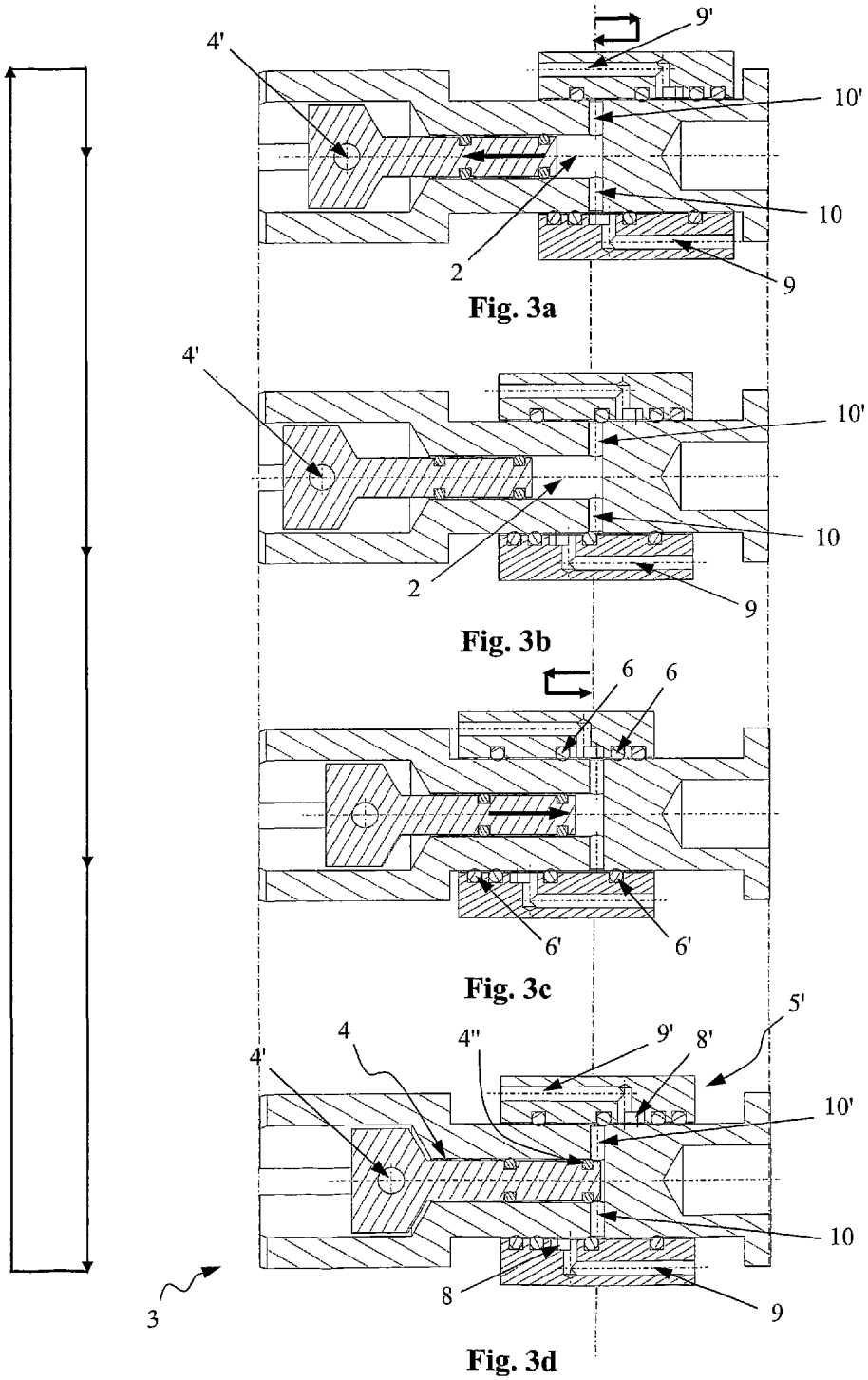
FIG. 3*a* shows an axial cross-sectional view of the volumetric pump of FIG. 1 during a piston instroke when the inlet and outlet valves are respectively open and closed (Filling phase)
FIG. 3*b* shows a similar axial cross-sectional view of the volumetric pump at the end of the piston instroke with both inlet and outlet valves closed.
FIG. 3*c* shows a similar axial cross-sectional view of the volumetric pump during a piston outstroke when the inlet and outlet valves are respectively closed and open (releasing phase)
FIG. 3*d* shows a similar axial cross-sectional view of the volumetric pump at the end of the piston outstroke with both inlet and outlet closed.
Figure 4:
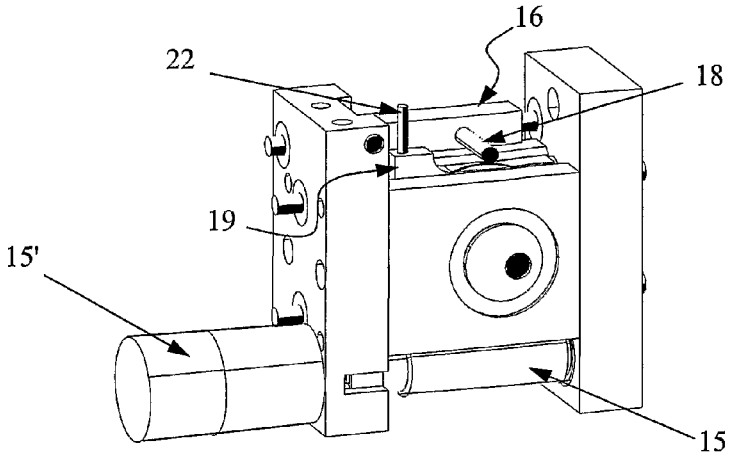
FIG. 4 shows a perspective view of a mechanism for driving the volumetric pump of the first embodiment of the invention through the different sequences as shown in FIGS. 3*a* to 3*d;*

A shown by FIGS. 3*a* to 3*d*, the piston stroke and the to-and-fro linear movement of the valve system are synchronized such that in the course of a pumping cycle, the following sequences are performed:

the piston instroke begins and the valve system 5, 5' slightly moves in one direction along the pump housing 3 so the elongated inlet aperture 8 of valve system 5, 5' remains continuously aligned with the inlet through-hole 10 to connect the piston chamber to the inlet channel 9 during the entire instroke of the piston 4 so that fluid can be sucked through the inlet channel 9 into said chamber (FIG. 3*a*);

at the end of the piston instroke, the valve system remains in movement further along the pump housing 3 to align the elongated outlet aperture 8' of valve system 5, 5' with the outlet through-hole 10' to connect the piston chamber to the outlet channel 9', such movement occurring during the time when no pumping movement occurs (so-called idle time) (FIG. 3*b*);

the piston outstroke begins while the valve system 5, 5' slightly moves even further along the pump housing 3 so the elongated outlet aperture 8' of valve system 5, 5' remains continuously aligned with the outlet through-hole 10 to connect the piston chamber to the outlet channel 9 during the entire outstroke of the piston 4 so that fluid can be expelled out of the chamber through the outlet channel 9 (FIG. 3*c*);

at the end of the piston outstroke, the valve system 5, 5' moves in the opposite direction along the pump housing 3 (FIG. 3*d*) during the idle time in order to align the inlet aperture 8 with the chamber for a new pumping cycle.

Figure 5:
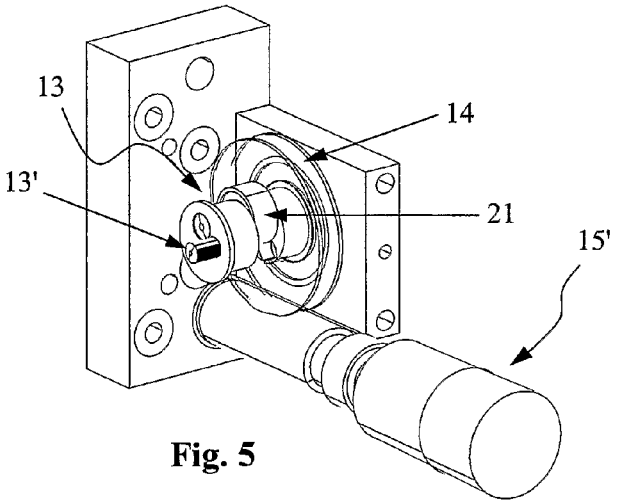
FIG. 5 is a perspective view of this driving mechanism partly disassembled to show a crankshaft.

As shown by FIGS. 4 to 8*b*, the piston 4 and the valve system 5, 5' movements are imparted by a driving mechanism that comprises a crankshaft 13 (FIG. 7) possessing two eccentric shafts 13', 13" angularly offset from each other by 90° (FIGS. 8*a* and 8*b*) in order to make sure that the inlet and outlet commutations occur during the two idle times of a pumping cycle. One (namely valve system driving shaft 13') of the two eccentric shafts 13', 13" is located at one end of the crankshaft 13 and is adapted to impart a to-and-fro linear movement to the linearly-actuable valve system while the other (namely piston driving shaft 13") of the two eccentric shafts 13', 13" is located near the middle of the crankshaft 13 and is adapted to impart a to-and-fro linear movement to the piston 4 of the volumetric pump. The other end of said crankshaft 13 is mounted on a driven toothed wheel 14 in gear with a worm screw 15 connected to a rotor 15' (FIG. 5).

Figure 6:
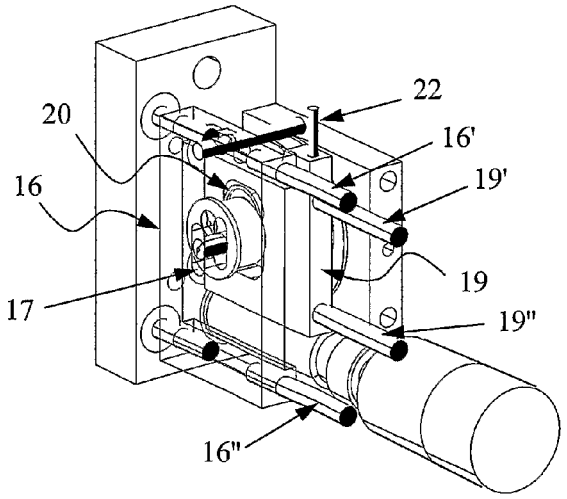
FIG. 6 is a perspective view of this driving mechanism partly disassembled to show a to-and-fro slidable piston and valve trays.
Figure 7:
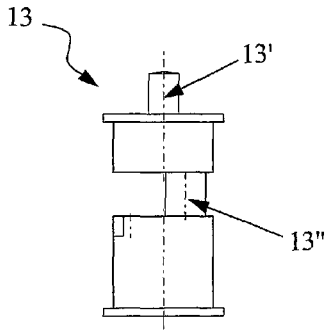
FIG. 7 shows an elevation view of a driving mechanism crankshaft comprising a piston and a shaft for driving the valve system.
Figure 8A:
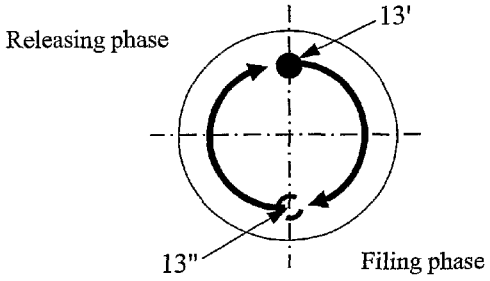
FIGS. 8*a* and 8*b* schematically show a side view of FIG. 7 with respectively the valve system and piston driving shafts.
Figure 8B:
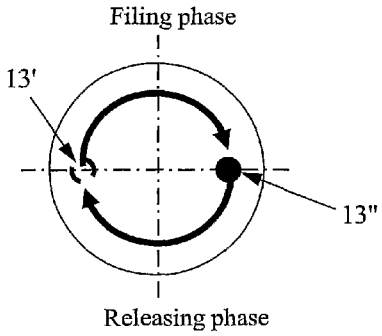

As can be seen from FIG. 6, the upper and lower parts of a valve tray 16 are slidably mounted respectively on a first and second supporting rod 16', 16" such that the slidable valve tray 16 is positioned in a first vertical plane. Said tray 16 comprises a vertical elongated opening 17 inside which the extremity of the valve system driving shaft 13' is adjusted. A valve system driving pin 18 (FIG. 4) is mounted perpendicular to the upper part of the valve tray 16 and is arranged to be clipped into a half cylindrical-shaped recess 18' located on the bottom part of the inlet and outlet valve holder 5, 5' of the valve system (FIG. 2).

The upper and lower part of a piston tray 19 is slidably mounted respectively on a third and fourth rod 19', 19" so that the slidable piston tray 19 is positioned in a second vertical plane parallel to the first vertical plane. Said piston tray 19 comprises a vertical rectangular aperture 20 inside which a ball bearing 21 disposed around the piston driving shaft 13" is inserted. The ball bearing diameter is slightly inferior to the width of the rectangular aperture 20 to create a lateral play (not shown) which produces the two idle times of a pumping cycle. A piston driving pin 22 protrudes vertically from the upper part of the piston tray 19 and is arranged to be inserted in a through hole 4' located in the piston head (FIG. 2).

Rotation of the crankshaft 13 triggers a to-and-fro horizontal movement of the valves and the piston trays 16, 19 along their respective supporting rods 16, 16', 19', 19" causing a to-and-fro horizontal movement of the piston 4 and of the valve system driving pins 18, 22.

Figure 9:
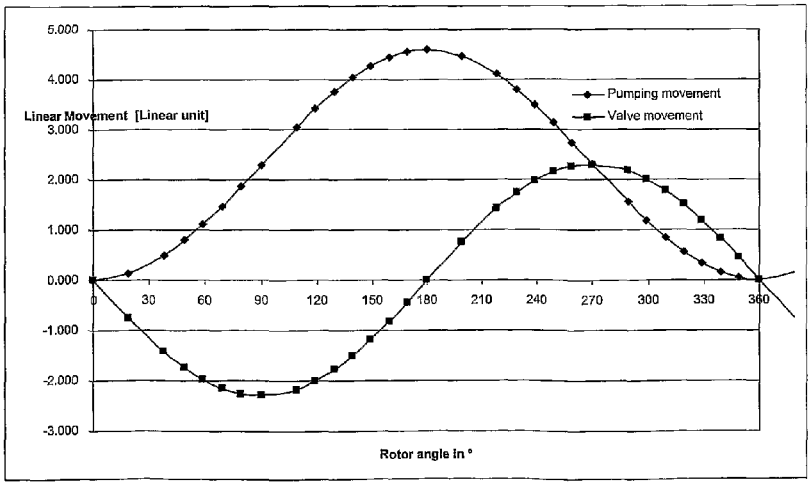
FIG. 9 represents a graph depicting a preferred evolution of the piston stroke versus the piston driving shaft rotation and the valve system linear movement versus the valve driving shaft rotation.
Figure 10:
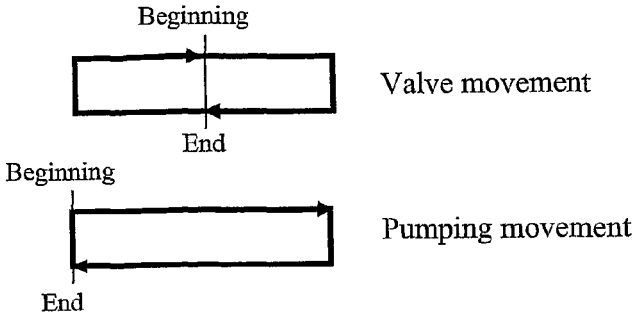
FIG. 10 shows a schematic representation of the piston(s) stroke cycle versus the valve system movement cycle.

The piston stroke and the valve system movement are imparted respectively by a piston driving shaft and a valve system driving shaft whose rotation about its respective axis are independent from each other and follow preferably the cycles as shown in FIGS. 9 and 10.

It has to be noted that the volumetric pump can operate efficiently without the above-mentioned play since the limited distance traveled by both pistons inside their cylinders during valve commutation would create a reasonable overpressure or under pressure inside the chambers which would be purged when the inlet and outlet valves open.

Figure 11:
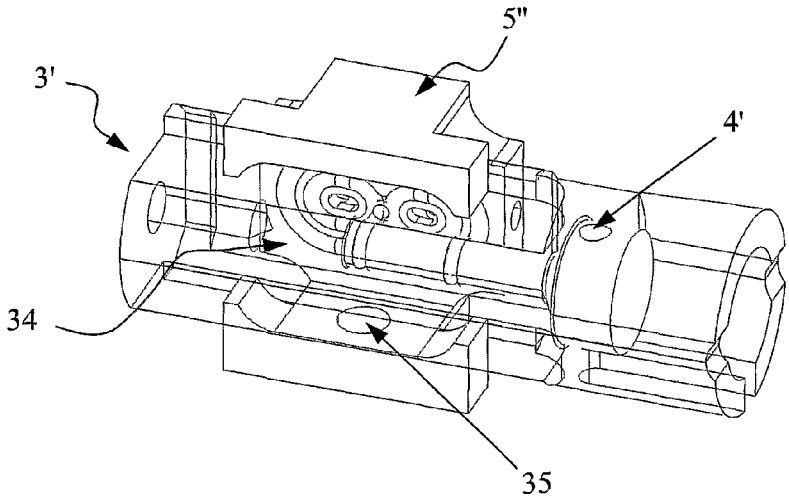
FIG. 11 shows a perspective view of a volumetric pump according to a variant of the first embodiment of the invention.
Figure 12:
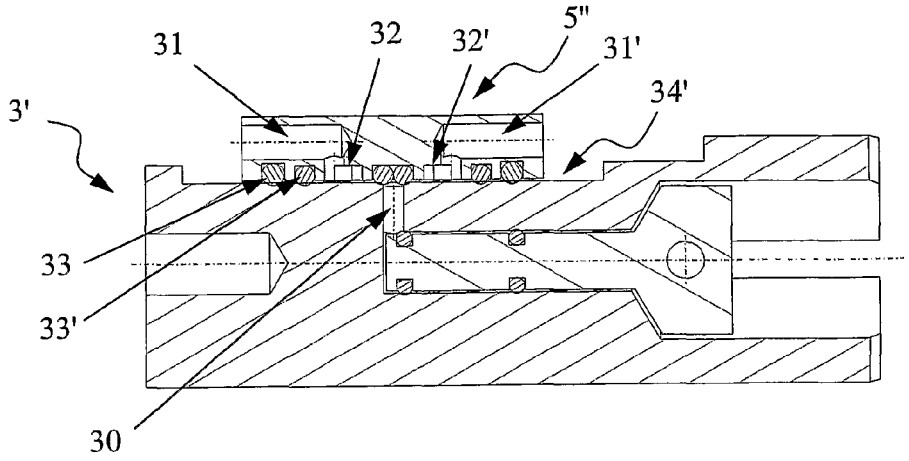
FIG. 12 shows an axial cross-sectional view of FIG. 11.
Figure 13:
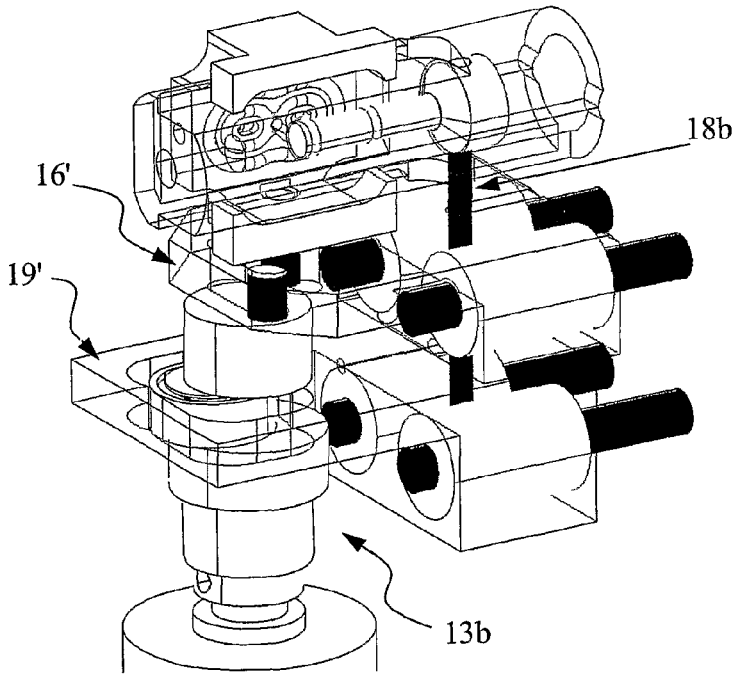
FIG. 13 shows a mechanism for driving the volumetric pump shown in FIG. 11.

According to a variant of the first embodiment of the invention as shown by FIGS. 11 to 13, the housing 3' of the volumetric pump comprises a single through-hole 30 extending from the piston chamber to the housing surface. The to-and-fro linearly-actuable valves system 5" comprises an inlet channel and outlet channel 31, 31', each of said channels 31, 31' being connected to respectively an elongated inlet and outlet aperture 32, 32'. O-rings or gaskets 33, 33' are placed on a flat rectangular surface 34 around the inlet and outlet aperture 32, 32'. The valve system 5" is arranged such that its flat surface 34 is sealed on one lateral side of the housing against a rectangular flat surface 34' and is linearly actuable by a to-and-fro movement along said housing 3' to align alternately the through hole 30 of the housing 3' with the inlet channel 31 during the piston instroke and the outlet channel 31' during the piston outstroke.

This volumetric pump is actuable by a driving mechanism as shown by FIG. 13. This driving mechanism comprises valve and piston trays 16', 19' which, unlike the driving mechanism described in the first embodiment of the invention, are positioned according to a horizontal plane parallel to each other and actuated by a crankshaft 13*b* which rotates about a vertical axis. Valve and piston driving pins 18*b*, 22*b* protrude vertically from the upper part of the valve and piston trays 16', 19' respectively. An opening 35 (FIG. 11) is realized on the lower part of the valve system to receive the valve system driving pin 18*b*.

Figure 14:
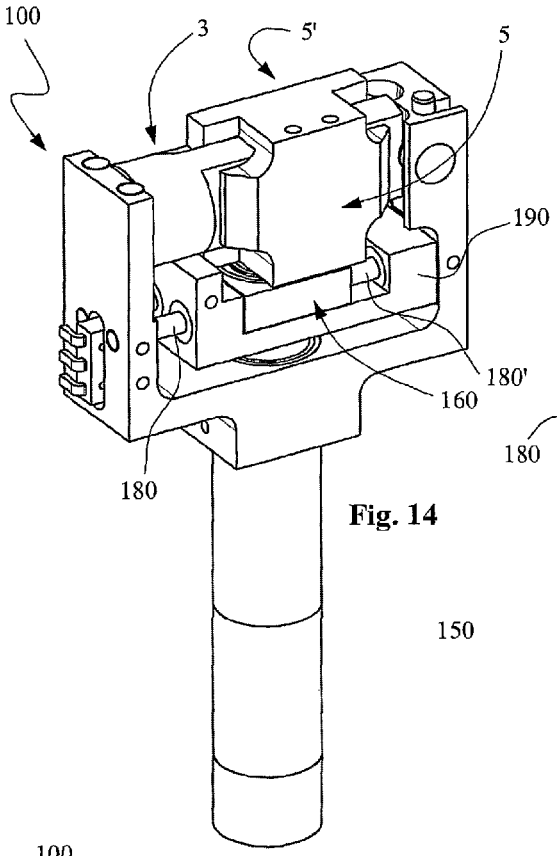
FIG. 14 shows a perspective view of the volumetric pump of the first embodiment of the invention connected to a driving mechanism according to another embodiment.
Figure 15:
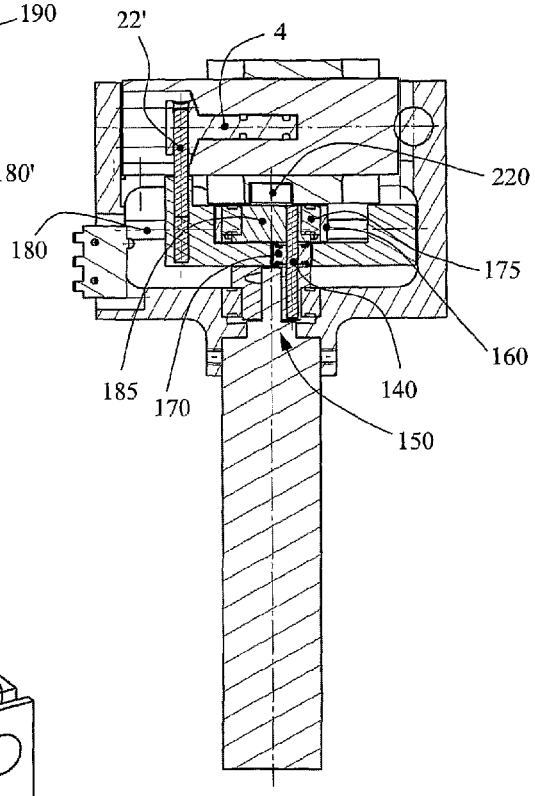
FIG. 15 shows a cross-sectional view of FIG. 14.
Figure 16:
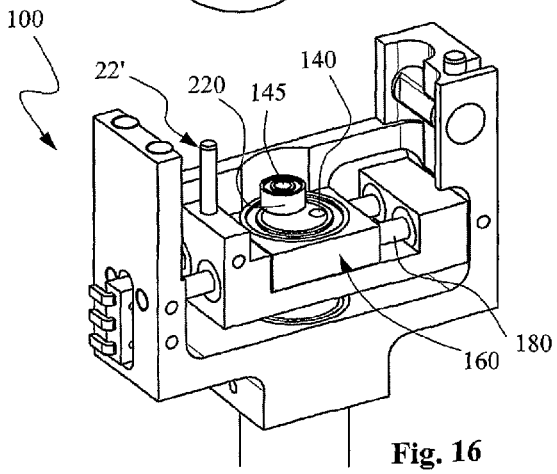
FIG. 16 shows a perspective view of the driving mechanism of FIG. 14 without the volumetric pump.
Figure 17:
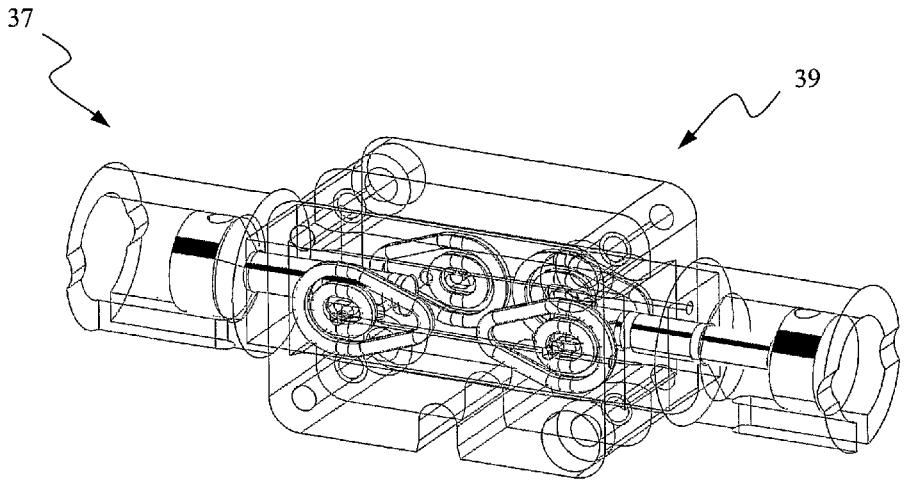
FIG. 17 shows, in a see-through perspective view, a volumetric pump comprising a first and a second piston arranged along a longitudinal axis inside a first and a second hollow cylindrical part according to a second embodiment of the invention.

In a preferred embodiment, this volumetric pump is driven by a driving mechanism as shown by FIGS. 14 to 16 which is designed to minimize the size of said mechanism. The main components of this driving mechanism are held inside a U-shaped supporting element 100. The lower part of supporting element 100 comprises a tray 190 slidably mounted on two pairs of rods 180, 180', each pair of rods 180, 180' protruding perpendicularly from each side of the U-shaped supporting element 100 and extending beyond the lateral distance travelled by the tray 190. A piston driving pin 22' is arranged to protrude vertically from said tray 190 through the piston head 4' (FIG. 2) of the volumetric pump which is mounted across the upper part of the U-shaped supporting element 100. A first ball bearing 170 is mounted inside the tray 190 to receive a first eccentric shaft 140 mounted eccentrically on and driven by a rotary shaft 150. The eccentric movement of shaft 140 imparts a to-and-fro horizontal sliding movement to the tray 190 along the rods 180, 180', which in turn actuates, by means of driving pin 22', a to-and-fro linear movement of piston 4 inside its chamber. A rotating part 185 is arranged inside a second ball bearing 175 mounted on a supporting piece 160 which is arranged between the two pairs of rods 180, 180'. A second eccentric shaft 145 (FIG. 16) is mounted to protrude vertically from the rotating part 185 angularly offset by 90° from the first eccentric shaft 140. A third ball bearing 220 is arranged around said second eccentric shaft 145 and is adapted to be slidably mounted on a groove (not shown) located at the bottom of the valve system 5, 5'. As a result, valve system 5, 5' is actuated, by means of third ball bearing 220, to move back and forth along the housing 3 of the volumetric pump and the movement of valve system 5, 5' is synchronized with the to-and-fro linear movement of piston 4 inside its chamber to make sure that the inlet and outlet commutations occur during the two idle times of a pumping cycle.

In a variant (not shown), one pair of rods 180, 180' is removed and the tray 190 is arranged to be slidable on one side only of supporting piece 160. In another variant (not shown) each pair of rod 180, 180' can be replaced by sliding rails.

According to a second embodiment of the invention as shown by FIGS. 17 to 20 and 22*a* to 22*d*, the volumetric pump comprises a first and second hollow cylindrical part 36, 36' located inside a regular rectangular prism-shaped housing 37 along a longitudinal axis; a first and second piston 38, 38' mounted to move back and forth inside respectively the first and second cylindrical part 36, 36' of the housing 37; and a to-and-fro linearly-actuable valve system 39. The first hollow cylindrical part 36 comprises a first inlet and outlet through-hole 40*i*, 40*o* arranged opposite to each other and extending from the first piston chamber to the housing external surface while the second hollow cylindrical part 36' comprises a second inlet and outlet through-hole 40*i'*, 40*o'* arranged opposite each other and extending from the second piston chamber to said housing external surface.

The to-and-fro linearly actuable valve system 39 is composed of a first and second inlet valve holder 41 and a first and second outlet valve holder 41'. Each of these two holders 41, 41' has a flat rectangular surface 42 comprising a first and second gasket or O-ring 43, 43' arranged around a first and second elongated aperture 44*i*, 44*i'*, 44*o*, and 44*o'*. The two apertures 44*i*, 44*i'* of the inlet valve holder 41 are connected preferably to a single inlet channel 45 while the two apertures 44*o*, 44*o'* of the outlet holder 41' are preferably connected to a single outlet channel 45'. Yet, the two inlet and outlet apertures can be directly connected to a first and second inlet ports and to a first and second outlet ports.

Figure 18:
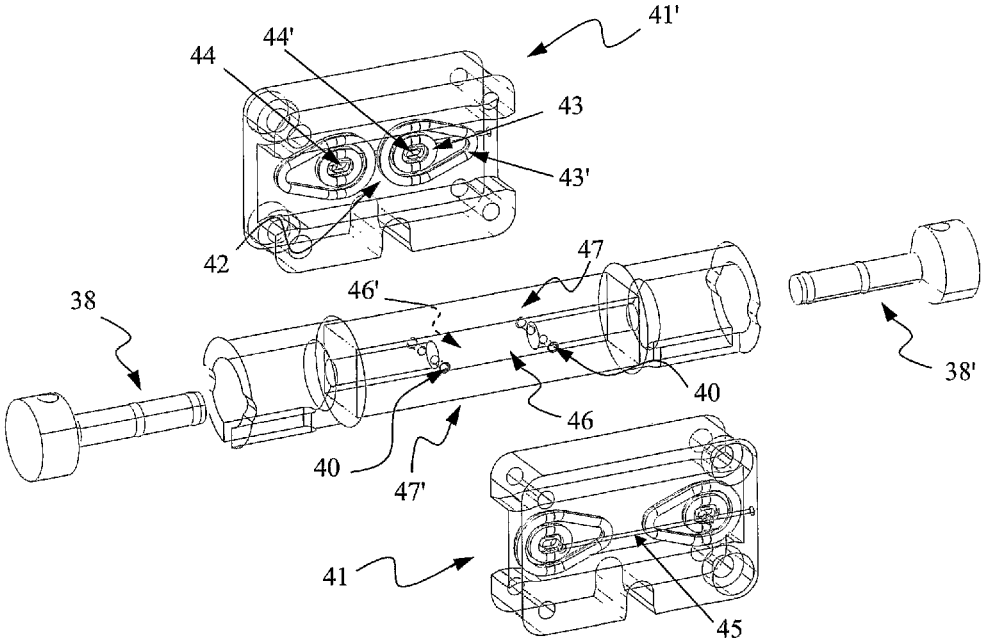
FIG. 18 shows an exploded view of the principal components of the volumetric pump as shown in FIG. 14, namely a housing comprising the first and second hollow cylindrical part, the two pistons, and two valve holders constituting the valve system.

The entire width of the upper and lower parts of each of the two holders 41, 41' comprises a projected rectangular part which is perpendicular to its rectangular surface 42 so that the two holders 41, 41' can be assembled opposite to each other in order to have their respective flat rectangular surface 42 resting against one of the two corresponding opposite lateral sides 46, 46' of the housing 37 while the upper and lower inner surfaces of the assembled valve system 39 are held against respectively the upper and lower lateral sides 47, 47' of the rectangular prism-shaped housing 37 (FIG. 18).

Figures 22A, 22B, 22C, 22D:
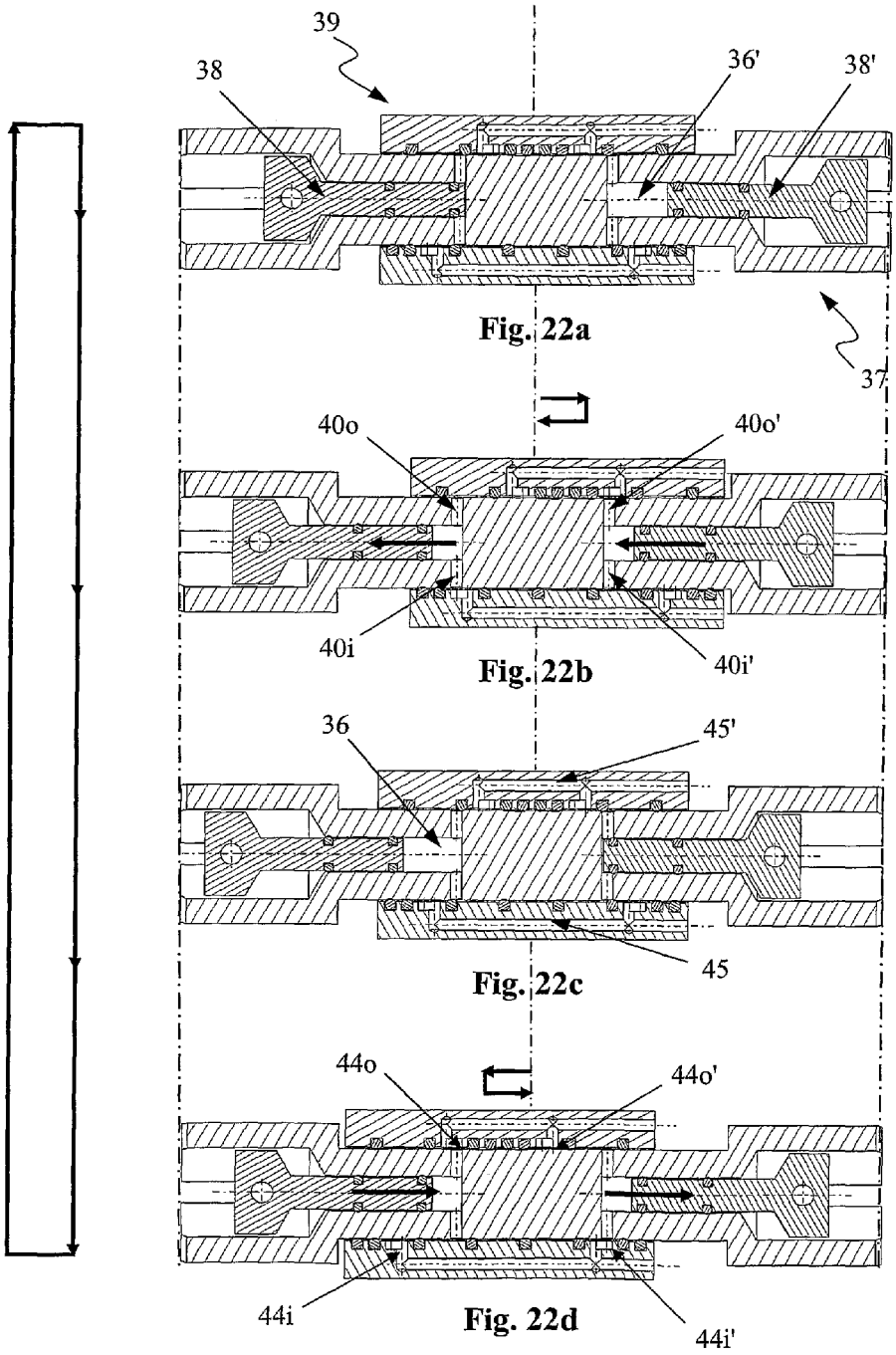
FIG. 22*a* shows an axial cross-sectional view of FIG. 14 at the beginning of a cycle, when there is no pumping movement and both inlet and outlet are closed.
FIG. 22*b* shows an axial cross-sectional view of FIG. 14 during the first piston instroke piston (the first chamber inlet and outlet valves are respectively open and closed) and during the second piston outstroke (the second chamber inlet and outlet valves are respectively closed and open)
FIG. 22*c* shows an axial cross-sectional view of FIG. 14 at the end of the first piston instroke and the second piston outstroke (at this time, all the inlet and outlet valves are closed)
FIG. 22*d* shows an axial cross-sectional view of FIG. 14, during the first piston outstroke (the first chamber inlet and outlet valves are respectively closed and open) and during the second piston instroke (the second chamber inlet and outlet valves are respectively open and closed)

A shown by FIGS. 22*a* to 22*d* the piston strokes and the valve system movements are imparted by a driving mechanism described hereafter so that the following sequences occur during a pumping cycle:

the first piston instroke and the second piston outstroke begin while the valve system 39 moves in one direction along the pump housing 37 at a reduced speed so the first elongated aperture 44*i* of the inlets valve holder 41 remains continuously aligned with the first inlet through-hole 40*i* to connect the first piston chamber with the inlet channel 45 while the second elongated aperture 44*o'* of the outlet valve holder 41' is continuously aligned with the second outlet through-hole 40*o'* to connect the second piston chamber with the outlet channel 45' so that the first piston instroke sucks fluid into the first chamber while the second piston outstroke expels fluid out of the second chamber (FIG. 22*b*);

at the end of the first piston instroke and the second piston outstroke, the valve system 37 moves further along the pump housing 37 to align, on the one hand, the first outlet aperture 44*o* with the first outlet through-hole 40*o* to connect the first piston chamber with the outlet channel 45' and to align, on the other hand, the second inlet aperture 44*i'* with the second inlet through-hole 40*i'* to connect the second piston chamber with the inlet channel 45, such movement occurring during the idle time (no pumping movement) (FIG. 22*c*);

the first piston outstroke and the second piston instroke begin while the valve system 39 moves even further along the pump housing 37 so the second elongated aperture 44*i'* of the inlets valve holder 41 remains continuously aligned with the second inlet through-hole 40*i'* to connect the second piston chamber with the inlet channel 45 while the first elongated aperture 44*o* of the outlet valve holder 41' is continuously aligned with the first outlet-through hole 40*o* to connect the first piston chamber with the outlet channel 45' so that the first piston outstroke expels fluid out of the first chamber while the second piston instroke sucks fluid into the second chamber (FIG. 22*d*);

at the end of the first piston outstroke and the second piston instroke, the valve system moves in the opposite direction along the pump housing 37 (FIG. 22*a*) to reach its initial position and begin another pumping cycle.

Figure 19:
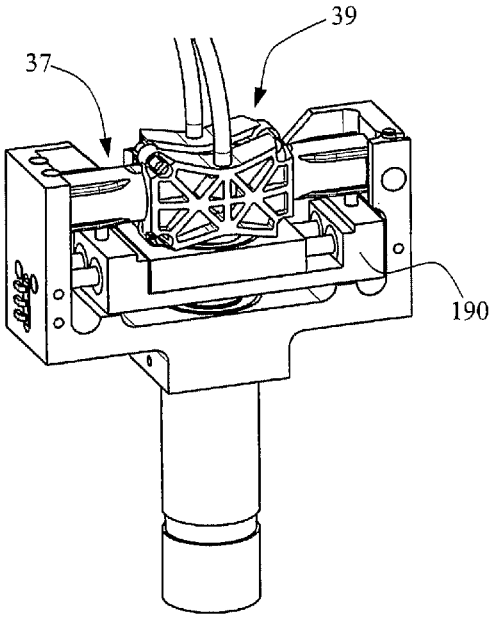
FIG. 19 shows a perspective view of the volumetric pump of the second embodiment of the invention connected to the driving mechanism of FIG. 16 slightly adapted for driving the volumetric pump of FIG. 19.
Figure 20:
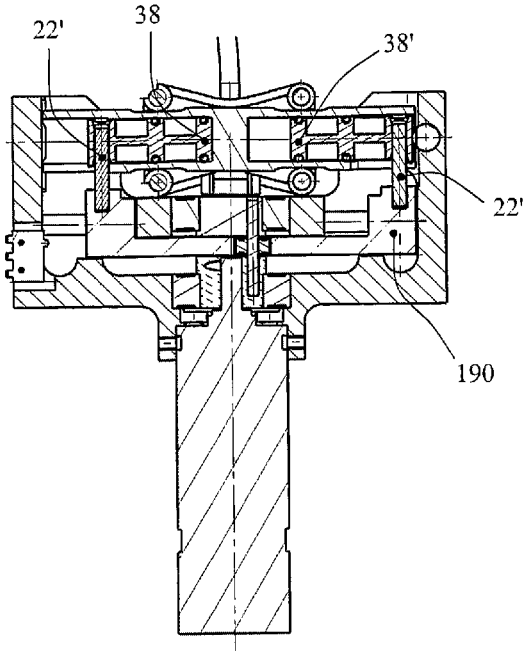
FIG. 20 shows a cross-sectional view of FIG. 14.
Figure 21:
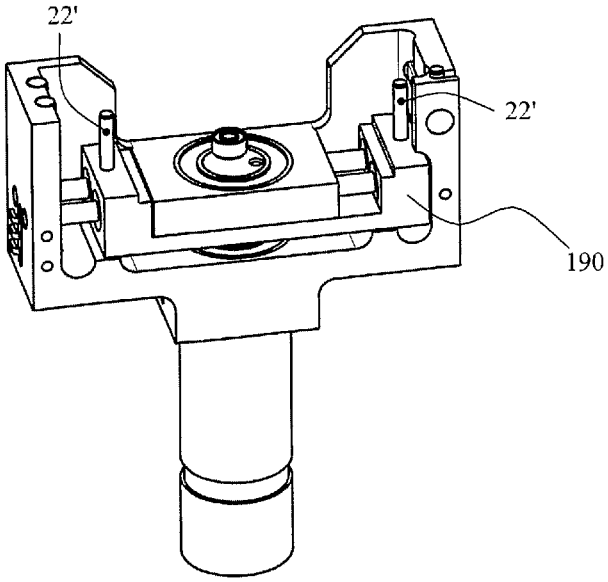
FIG. 21 shows a perspective view of the driving mechanism of FIG. 19 without the volumetric pump.

As shown by FIGS. 19 to 21, the to-and-fro linear movement of first and second pistons 38, 38' inside the housing 37 of the volumetric pump of the second embodiment of the invention, and the back and forth movement of valve system 39 along said housing 37, are imparted by a driving mechanism identical to the driving mechanism of the preferred embodiment for driving the volumetric pump according to the first embodiment of the invention (FIGS. 14 to 16), except that it comprises a first and second piston driving pins 22' which protrude vertically from the piston tray 190 and are aligned to be inserted in a through hole located in the first and second piston 38, 38'.

Figure 23:
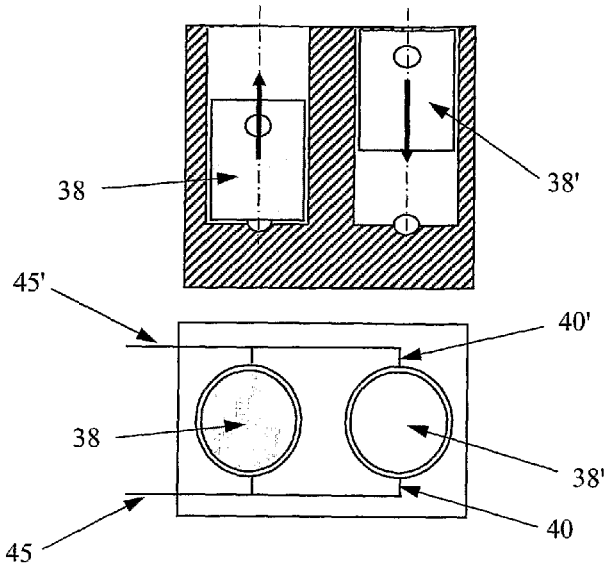
FIG. 23 shows a schematic cross-sectional view and top view of a volumetric pump comprising two pistons arranged in parallel according to a variant of the second embodiment of the invention.
Figure 24:
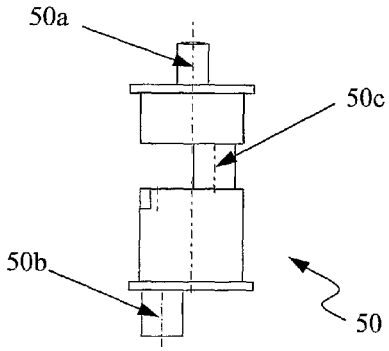
FIG. 24 shows an elevation view of a driving mechanism crankshaft for driving the volumetric pump as shown in FIG. 17, said crankshaft comprising a first piston driving shaft, a second piston driving shaft, and a valve system driving shaft.
Figures 25A, 25B, 25C:
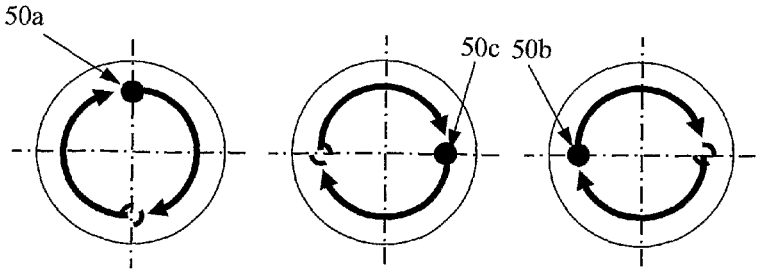
FIGS. 25*a*, 25*b* and 25*c* schematically show a side view of FIG. 24 with respectively the valve system driving shaft, the first piston driving shaft and the second piston driving shaft.
Figure 26:
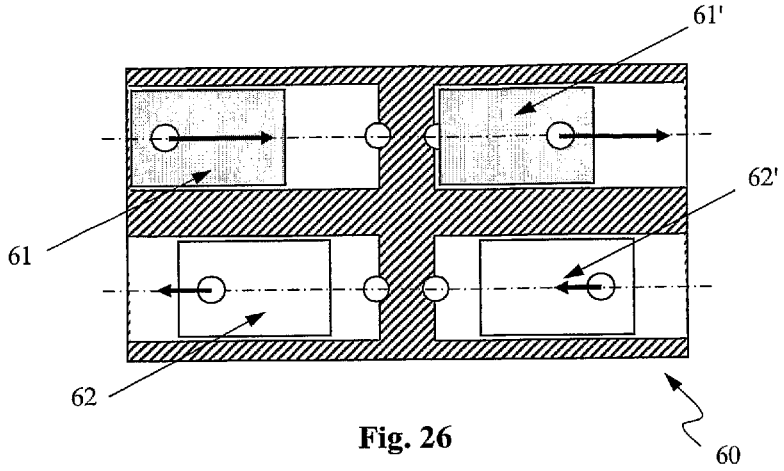
FIG. 26 shows a schematic cross-sectional view of a volumetric pump according to a third embodiment of the invention.

In a variant of the second embodiment of the invention as shown by FIG. 23, the first and second pistons 38, 38' are not mounted on a single axis but in parallel. In this configuration, the driving mechanism comprises a crankshaft 50 with three eccentric shafts 50*a*, 50*b* and 50*c* as shown by FIGS. 24, 25*a*, 25*b* and 25*c*. One (namely valve driving shaft 50*a*) of the three eccentric shafts is located at one end of the crankshaft 50 and is adapted to impart a to-and-fro linear movement to the linearly-actuable valves system 37. One (namely first piston driving shaft 50*b*) of the two remaining shafts is located at the other end of the crankshaft 50 and is adapted to impart a to-and-fro linear movement to the first piston 38 while the other (namely second piston driving shaft 50*c*) is located near the middle of the crankshaft 50 and is adapted to impart a to-and-fro linear movement to the second piston 38'. The valve system driving shaft 50*a* is positively and negatively angularly offset by 90° from the first and second piston driving shafts 50*b*, 50*c* while said first piston and second piston driving shafts 50*b*, 50*c* are angularly offset from each other by 180°.

The volumetric pump according to the second embodiment of the invention and its variant deliver a quasi continuous flow.

The volumetric pump technical features according to the second embodiment of the invention and its variant make it possible to reduce the volume of the two chambers down to at least 2×0.02 ml to obtain a minimum continuous flow rate of 0.01 ml/h and a minimal increment of 25 nl.

For comparison, the limitations of the volumetric pump described in WO2006056828 are 2×0.1 ml for the volume of the chambers, 0.05 ml/h for the minimum continuous flow rate and 0.5 μl for the minimum increment.

In a third embodiment of the invention as schematically shown by FIGS. 26 to 28*d*, a volumetric pump comprises a square or rectangular prism-shaped housing 60 inside which are located a first pair of coupled pistons 61, 61' and a second pair of coupled pistons 62, 62'. Each pair of coupled pistons is arranged to work concomitantly like the first and second piston of the volumetric pump described in the third embodiment, said first and second pairs of coupled pistons being parallel to each other and aligned in a single plane.

Figure 27:
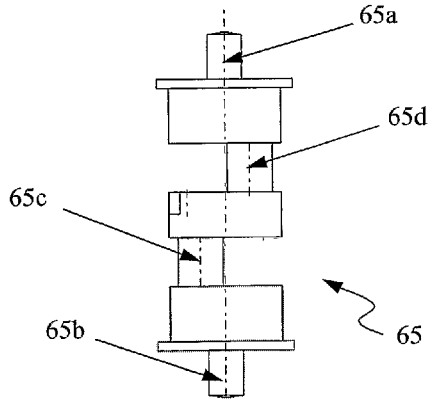
FIG. 27 shows an elevation view of a driving mechanism crankshaft for driving the volumetric pump of the third embodiment of the invention, said crankshaft comprising a first and second shafts for driving the valve system of the pump, a shaft for driving a first pair of coupled pistons, and a shaft for driving a second pair of coupled pistons.
Figures 28A, 28B, 28C, 28D:
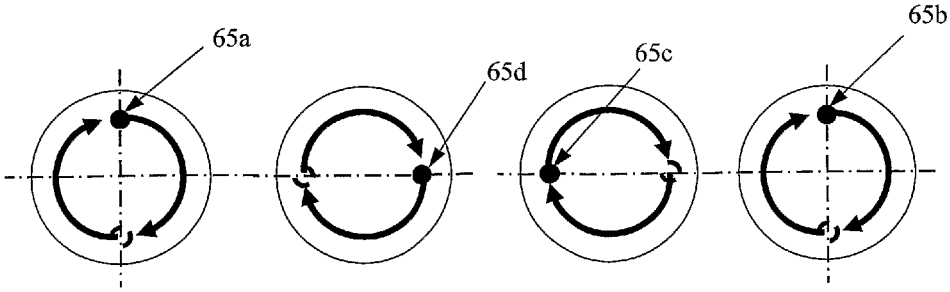
FIGS. 28*a*, 28*b*, 28*c* and 28*d* schematically show a side view of respectively one of the two valve system driving shafts, the first coupled pistons valve driving shaft, the shaft for driving the first pair of coupled pistons, the shaft for driving the second pair of coupled pistons, and the other of the two valve system driving shafts.

In this configuration, the crankshaft 65 of the driving mechanism, as shown by FIG. 27, comprises four eccentric shafts 65*a*, 65*b*, 65*c*, and 65*d* which are angularly offset from each other by 90°. One (65*a*) of the four eccentric shafts is located at one end of the crankshaft 65 and is adapted to impart a to-and-fro linear movement to a first valve holder coupled with the first pair of coupled pistons (not shown). One (65*b*) of the three remaining shafts is located at the other hand of the crankshaft 65 and is adapted to impart a to-and-fro linear movement to a second valve holder coupled with the second pair of coupled pistons. One of the two remaining shafts (65*c*) is adapted to impart a to-and-fro linear movement to the first pair of coupled pistons 61, 61' while the other (65*d*) is adapted to impart a to-and-fro linear movement to the second pair of coupled pistons 62, 62', the shafts 65*c*, 65*d* for driving both pairs of coupled pistons being offset from each other by 90°.

The valve system is composed of inlet and outlet valves holders (not shown), slidably mounted on two opposite lateral sides of the square or rectangular prism-shaped housing 60. The inlet and outlet holders comprise respectively four inlets and the outlets apertures.

One ordinary skilled in the art would obviously consider adding further pairs of coupled pistons in parallel with each others and aligned in a single plane to obtain a volumetric pump with an improved flow rate of the delivered fluid. A volumetric pump with n coupled pistons arranged in parallel would be driven by a mechanism comprising a crankshaft with n pairs of coupled pistons driving shafts angularly offset from each other by an angle of 180°/n.

Figure 29:
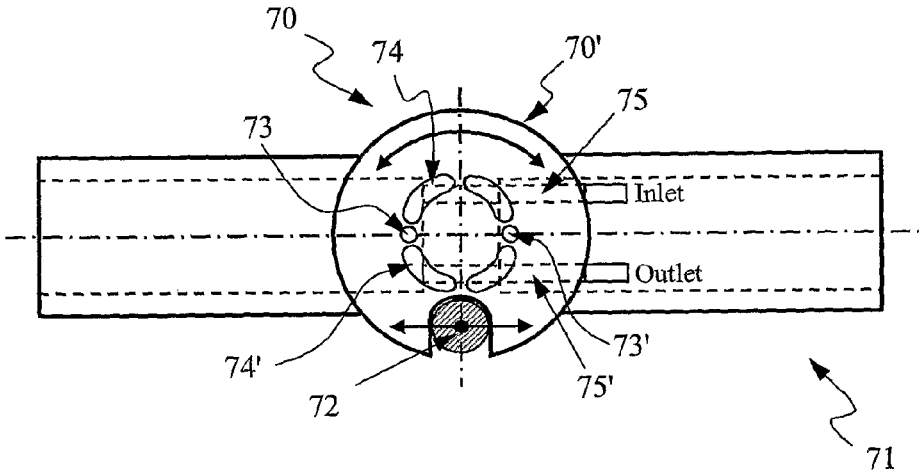
FIG. 29 shows a schematic view of a volumetric pump according to a fourth embodiment of the invention.

In a fourth embodiment of the invention, as shown by FIG. 29, the volumetric pump comprises a valve system 70 which is not linearly-acutable as described in the preceding embodiments but rotatably actuable. In this configuration, the pump driving mechanism is identical to the pump driving mechanism used for driving the volumetric pump according to the second embodiment of the invention. The to-and-fro linear movement of the valve system pin 72 actuates a back and forth angular movement of the valve system 70 around its rotating axis. The valve system 70 comprises a rotatable disc 70' mounted against one lateral side of the pump housing 71. The disc 70' comprises two curved inlet apertures 74 connected to an inlet port 75 and two curved outlet apertures 74' connected to an outlet port 75', said apertures 74, 74' being arranged to be aligned alternately with a through-hole 73 connected to a first piston chamber and a second through-hole 73' connected to a second piston chamber.

The valve system 70 can also be composed of two discs arranged against two opposite lateral sides of the pump housing. This embodiment is not limited to the valve arrangements specifically disclosed in FIG. 29 but also includes any kind of valve arrangements which would allow sucking and expelling fluid by the combined angular movement of the valve system around its rotating axis with the to-and-fro linear movement of the pistons. Besides, the volumetric pump according to this embodiment can be adapted to comprise multiple pairs of coupled pistons.

Figure 30:
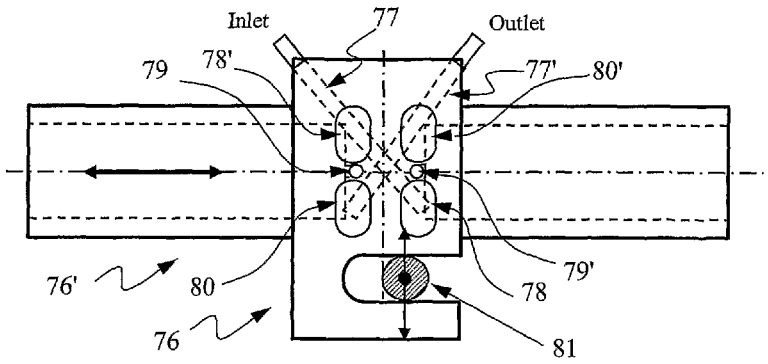
FIG. 30 shows a schematic view of a volumetric pump according to a further embodiment of the invention.

In a further embodiment, as shown by FIG. 30, the volumetric pump comprises a linearly-actuable valve system 76 arranged to have a linear movement which is perpendicular to the movement of a first and a second piston. The valve system 76 is mounted against at least one lateral side of the pump housing 76' and comprises an inlet and an outlet channel 77, 77' connected respectively to an inlet and an outlet ports. The Inlet channel 77 comprises a first inlet aperture 78 and a second inlet aperture 78' which are connectable, via a first through-hole 79 of the pump housing 76', to the first piston chamber while the outlet channel 77' comprises a first outlet aperture 80 and a second outlet aperture 80' which are connectable, via a second through-hole 79' of the pump housing 76', to the second piston chamber. The inlet and outlet apertures 78, 78', 80 and 80' are arranged to be aligned alternately with the first and second through-holes 79, 79' in order to connect alternately the inlet and outlet ports of the volumetric pump with the first and second piston chambers during alternate pistons instrokes and outstrokes.

Figures 31A, 31B, 31C:
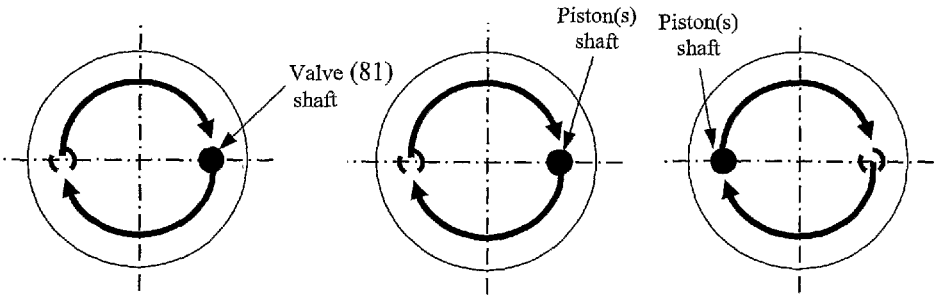
FIGS. 31*a* and 31*b* schematically show a side view of a crankshaft adapted to drive the volumetric pump shown in FIG. 30 with respectively a valve system driving shaft and a piston(s) driving shaft.
FIG. 31*c* schematically show a side view of a crankshaft adapted to drive the volumetric pump shown in FIG. 30 with the piston(s) driving shaft shifted by 180° from the valve system driving shaft according to a variant.

This volumetric pump can be driven by a single main shaft comprising a first eccentric driving shaft (pistons driving shaft) (FIG. 31*b*) adapted to impart a to-and-fro horizontal movement to the first and second pistons, and a second eccentric driving shaft (valve system driving shaft, 81) adapted to impart a to-and-fro vertical movement to the valve system. The first and second eccentric driving shafts are angularly aligned with each other. The volumetric pump according to this embodiment can also be driven by a driving mechanism comprising a piston driving shaft and a valve system driving shaft which are offset from each other by an angle of 180°.

Like the fourth embodiment of the invention, this embodiment is not limited to the valve arrangements specifically disclosed in FIG. 30 but also includes any kind of valve arrangements which would allow sucking and expelling fluid through the relative to-and-fro perpendicular movement between the valve system and the pistons movement. Besides, the volumetric pump according to this embodiment can also be adapted to comprise multiple pairs of coupled pistons.

Figure 32:
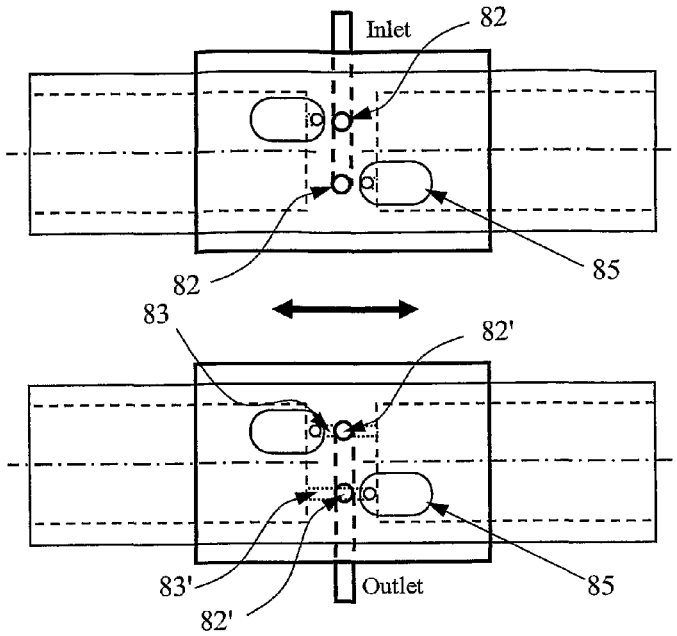
FIGS. 32, 33 and 34 schematically show different configurations of the valve arrangements of the volumetric pump.
Figure 33:
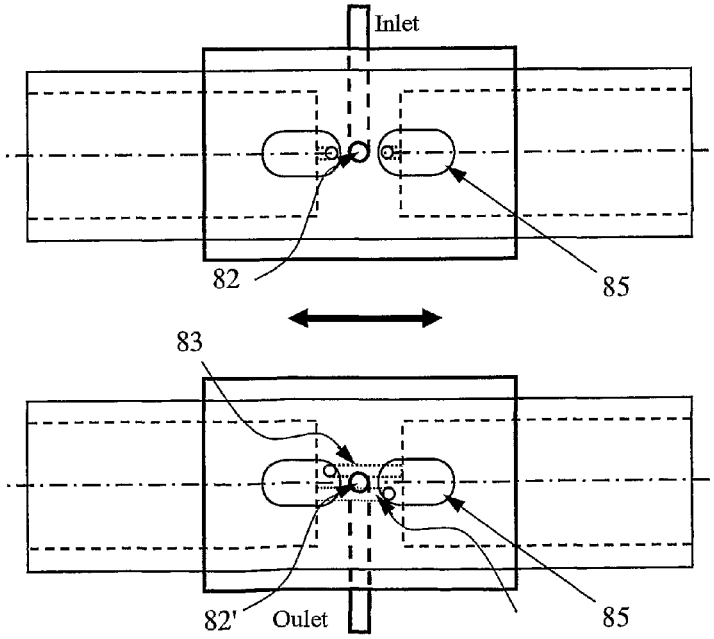
Figure 34:
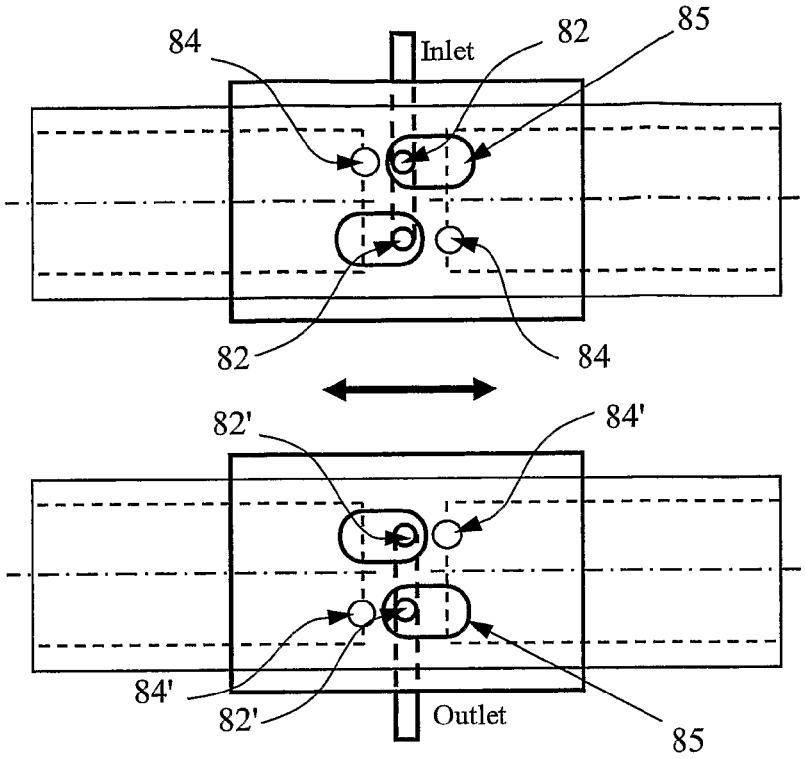

FIGS. 32, 33 and 34 schematically show different configurations of the valve arrangements which can be used for the volumetric pump according to the second embodiment of the present invention and more particularly, the arrangement of the inlet and outlet apertures 82, 82', the inlet and outlet channels 83, 83', the inlet and outlet through-holes 84, 84' of the pump housing and the gaskets 85. In FIGS. 32 and 33, the gaskets 85 are part of the pump housing and are therefore immobile while in FIG. 34 the gaskets 85 are part of the valve system and are therefore actuable by a to-and-from linear movement.

The volumetric pump housing according to some embodiments of the invention can comprise a right circular or elliptic cylindrical outer surface and at least one valve holder comprising a corresponding incurved surface which is held slidable alongside a part of said circular or elliptic cylindrical outer surface.

All parts of the volumetric pump as described in the different embodiments of the invention are preferably disposables. All sealing members are preferably O-rings or over-molded parts.

While the invention has been described with reference to certain embodiments, it will be understood by those skilled in the art that various changes may be made and equivalents may be substituted without departing from the scope of the present invention. In addition, elements and/or features of different illustrative embodiments may be combined with each other and/or substituted for each other within the scope of this disclosure and appended claims. For example, one skilled in the art would contemplate to modify the volumetric pump such that each of the housing, the piston(s) and the valve system would be independently movable from each others or such that at least one of the housing, the piston(s) or the valve system would be fixed.

Besides, the movements imparted to the valve system and the piston(s) of the volumetric pump are not limited to the movements imparted by the driving mechanisms previously described. One skilled in the art would also consider adapting the volumetric pump and its driving mechanism such that the piston(s) and the valve system move along respectively a first and second axes which are aligned in a single plane and shifted from each other by a first acute angle between 0° and 90° (movement angle). In this configuration, a piston(s) shaft and a valve system shaft are offset from each other by an angle between 0° and 180° (offset angle), said system shaft and piston(s) shaft being arranged to form with the crankshaft's center a piston axis and a valve system axis which are offset from each other by a second acute angle such that the sum of the first acute angle and second acute angle equals to 90°.

The invention claimed is:

1. A volumetric pump comprising a housing containing at least one hollow elongated part, at least one piston arranged to move back and forth inside said elongated part, at least one inlet port and at least one outlet arranged so that a fluid can be sucked through the inlet port into a piston chamber during an instroke of the piston and expelled from the piston chamber through an outlet port during an outstroke of said piston, the housing comprising at least one through-hole extending from the piston chamber to a housing outer surface, the volumetric pump further comprising a linearly and/or angularly actuable valve system having at least one valve holder mounted on the pump housing outer surface against a lateral side of the pump housing such that a part of the at least one valve holder is held against a corresponding part of said lateral side, said at least one valve holder comprising at least one inlet and/or outlet aperture and being arranged to be linearly and/or rotatably actuable to align alternately the inlet and outlet apertures with the through-hole of the housing in order to connect alternately the inlet and outlet ports of the volumetric pump with the piston chamber during alternate piston instrokes and outstrokes, wherein the at least one valve holder of the valve system comprises the inlet and outlet ports of the volumetric pump such that said inlet and/or outlet port are linearly and/or rotatably actuable along with the valve holder, the volumetric pump further comprising a driving mechanism comprising a crankshaft possessing an eccentric shaft arranged upon rotation of the crankshaft to impart a to-and-fro linear movement to the valve system; wherein the at least one valve holder comprises a first valve holder called an inlet valve holder slidably mounted along a longitudinally-extending lateral side of the housing, and a second valve holder called an outlet valve holder slidably mounted along another longitudinally-extending lateral side of the housing, wherein the inlet valve holder comprises the said at least one inlet aperture arranged to be aligned with one inlet through-hole of the housing in order to connect the piston chamber with the inlet port during the instroke of the piston; and wherein the outlet valve holder comprises the said at least one outlet aperture arranged to be aligned with an outlet through-hole of the housing in order to connect the piston chamber with the outlet port during the outstroke of the piston.

2. A volumetric pump according to claim 1, wherein the at least one valve holder comprises sealing members arranged around the inlet and/or outlet aperture, said sealing members being held against the housing outer surface to seal the inlet and outlet port of the volumetric pump.

3. A volumetric pump according to claim 2, wherein the sealing members of the at least one valve holder are O-rings, gaskets or over-molded parts.

4. A volumetric pump according to claim 1, wherein the valve system comprises a bottom part having therein a groove adapted to receive a driving member of a driving mechanism.

5. A volumetric pump according to claim 1, wherein the at least one valve holder, the housing and the at least one piston of the volumetric pump are disposables.

6. A volumetric pump according to claim 1, wherein the housing comprises two opposite longitudinally-extending sides, and the inlet and outlet holders are connected together and mounted opposite to each other, each being movable along one of said two opposite longitudinally-extending sides of the housing.

7. A volumetric pump according to claim 1, including a driving mechanism comprising:

- a tray which is slidably mounted on guiding means that protrude perpendicularly from at least one side of a lower part of a U-shaped supporting element and extend beyond the lateral distance along which the tray is movable;
- a piston driving pin arranged to protrude vertically from the tray through the piston head of the at least one piston of the volumetric pump;
- a first ball bearing mounted inside the tray to receive a first eccentric shaft mounted eccentrically on and driven by a rotary shaft;
- a rotatable part arranged inside a second ball bearing mounted on a supporting piece;

a second eccentric shaft mounted to protrude vertically from the rotating part and to be angularly offset by 90° from the first eccentric shaft; and a third ball bearing arranged around the second eccentric shaft, said third ball bearing being adapted to be slidably mounted on a groove located at the bottom of the valve system.

8. A volumetric pump according to claim 7, wherein the guiding means are two pair of rods that protrude perpendicularly from each side of the lower part of the U-shaped supporting element, and wherein the supporting piece is arranged between the two pair of rods.

9. A volumetric pump according to claim 7, wherein the guiding means are sliding rails that protrude perpendicularly from each side of the lower part of the U-shaped supporting element, and wherein the supporting piece is arranged between the sliding rails.

10. A volumetric pump according to claim 1, wherein the volumetric pump housing is an elongated prism of polygonal cross-section or a cylinder of circular/elliptical cross section with an outer surface composed of longitudinally-extending lateral sides, and the at least one valve holder of the valve system comprises a corresponding flat or incurved surface which is held slidable along said outer surface of the pump housing.

11. A volumetric pump according to claim 1, wherein said driving mechanism's crankshaft possesses two eccentric shafts offset from each other by an angle between 0° and 180°, one of the eccentric shafts being said eccentric shaft arranged upon rotation of the crankshaft to impart a to-and-fro linear movement to the valve system, while the other eccentric shaft is arranged upon rotation of the crankshaft to impart a to-and-fro linear movement to the piston.

* * * * *